US011098716B2

(12) United States Patent
Sato

(10) Patent No.: US 11,098,716 B2
(45) Date of Patent: Aug. 24, 2021

(54) SCROLL FLUID MACHINE THAT MAINTAINS CONTROL ACCURACY OF BACK PRESSURE

(71) Applicant: SANDEN AUTOMOTIVE COMPONENTS CORPORATION, Isesaki (JP)

(72) Inventor: Taizo Sato, Isesaki (JP)

(73) Assignee: Sanden Automotive Components Corporation, Isesaki (JP)

( * ) Notice: Subject to any disclaimer, the term of this patent is extended or adjusted under 35 U.S.C. 154(b) by 176 days.

(21) Appl. No.: 16/342,961

(22) PCT Filed: Oct. 10, 2017

(86) PCT No.: PCT/JP2017/037294

§ 371 (c)(1),
(2) Date: Apr. 17, 2019

(87) PCT Pub. No.: WO2018/083965

PCT Pub. Date: May 11, 2018

(65) Prior Publication Data

US 2019/0293071 A1 Sep. 26, 2019

(30) Foreign Application Priority Data

Nov. 1, 2016 (JP) ..... JP2016-214501

(51) Int. Cl.
*F04C 15/00* (2006.01)
*F01C 21/00* (2006.01)
(Continued)

(52) U.S. Cl.
CPC ..... *F04C 18/0246* (2013.01); *F01C 1/02* (2013.01); *F01C 21/10* (2013.01); *F04C 18/02* (2013.01);
(Continued)

(58) Field of Classification Search
CPC .. F04C 18/0246; F04C 18/0215; F04C 29/02; F04C 29/0021; F04C 29/028;
(Continued)

(56) References Cited

U.S. PATENT DOCUMENTS 6,302,656 B1 * 10/2001 Hirota ..... F04B 27/1804 417/222.2
2004/0253133 A1 * 12/2004 Gennami ..... F04C 18/0215 418/55.1
(Continued)

FOREIGN PATENT DOCUMENTS

JP S60-172064 U 11/1985
JP 2007-224839 A1 9/2007
(Continued)

OTHER PUBLICATIONS

English translation of JP-2008019761 by Espacenet Mar. 23, 2021.*
(Continued)

*Primary Examiner* — Deming Wan
(74) *Attorney, Agent, or Firm* — Baker Botts L.L.P.

(57) ABSTRACT

The scroll-type compressor comprises a fixed scroll and an orbiting scroll engaged with each other; a back pressure control valve 50 inserted from the large-diameter side of the stepped-shaped pressure release passage L4 which communicates between a suction chamber H1 and a back pressure chamber H3 which applies a back pressure for pressing the orbiting scroll against the fixed scroll. The scroll-type compressor further comprises an O-ring 60 fitted in a circumferential groove 53*a* formed in the outer peripheral surface of the valve 50, and a ring member 61 press-fitted into the large-diameter side of the pressure release passage L4, and holds the valve 50 between the ring member 61 and the stepped portion. Then, the compressive stress is unlikely to be applied to the valve 50, and the deformation of the valve
(Continued)

50 is reduced to prevent the reduction in the control accuracy of the back pressure.

12 Claims, 4 Drawing Sheets

(51) Int. Cl.

| | |
|---|---|
| ***F04C 18/02*** | (2006.01) |
| ***F04C 29/02*** | (2006.01) |
| ***F04C 29/00*** | (2006.01) |
| ***F04B 53/16*** | (2006.01) |
| ***F01C 1/02*** | (2006.01) |
| ***F01C 21/10*** | (2006.01) |

(52) U.S. Cl.
CPC ..... *F04C 18/0215* (2013.01); *F04C 29/02* (2013.01); *F04C 2250/20* (2013.01)

(58) Field of Classification Search
CPC .... F01C 1/0246; F02M 59/485; F02M 59/48; F04B 53/168; B25B 27/24
USPC ..... 137/15.18, 315.27, 315.41
See application file for complete search history.

(56) References Cited

U.S. PATENT DOCUMENTS

2008/0066463 A1* 3/2008 Davison ..... B60T 13/162 60/459
2011/0243777 A1* 10/2011 Ito ..... F04C 27/005 418/55.2
2012/0148434 A1* 6/2012 Takabe ..... F01C 1/0246 418/55.2

FOREIGN PATENT DOCUMENTS

JP 2008019761 A * 1/2008 ..... F04C 18/02
JP 2012-207606 A1 10/2012

OTHER PUBLICATIONS

Japan Patent Office, International Search Report issued in International Application No. PCT/JP2017/037294, dated Dec. 5, 2017.
The State Intellectual Property Office of the People's Republic of China, The First Office Action issued in Chinese Patent Application No. 201780063871.X, dated Nov. 13, 2019.
The International Bureau of WIPO, International Preliminary Report on Patentability (Chapter I), issued in International Application No. PCT/JP2017/037294, dated May 16, 2019.

* cited by examiner

SCROLL FLUID MACHINE THAT MAINTAINS CONTROL ACCURACY OF BACK PRESSURE

CROSS-REFERENCE TO RELATED APPLICATIONS

This application is a U.S. National Stage Patent Application under 35 U.S.C. § 371 of International Patent Application No. PCT/JP2017/037294, filed on Oct. 10, 2017, which claims the benefit of Japanese Patent Application No. 2016-214501, filed on Nov. 1, 2016, the disclosures of each of which are incorporated herein by reference in their entirety.

TECHNICAL FIELD

The present invention relates to a scroll fluid machine that changes the capacity of a compression chamber defined by a fixed scroll and an orbiting scroll for compressing or expanding fluid.

BACKGROUND ART

A scroll-type compressor which is given as an example of a scroll fluid machine is provided with a scroll unit having a fixed scroll and an orbiting scroll which are engaged with each other. In the scroll unit, by causing the orbiting scroll to revolve around the axis of the fixed scroll, the capacity of a compression chamber defined by the fixed and orbiting scrolls increases and decreases to compress and discharge gaseous refrigerant. In the scroll-type compressor, a back pressure is applied to the back surface of the orbiting scroll to press the orbiting scroll against the fixed scroll. This prevents the orbiting scroll from departing from the fixed scroll during the compression operation, and makes insufficient compression unlikely. Here, the back pressure applied to the back surface of the orbiting scroll is adjusted to be a predetermined pressure by means of a back pressure control valve which is press-fitted into a communication passage that communicates between the back pressure chamber and suction chamber, as disclosed in JP2012-207606 A (Patent Document 1).

REFERENCE DOCUMENT LIST

Patent Document

Patent Document 1: JP 2012-207606 A

SUMMARY OF THE INVENTION

Problem to be Solved by the Invention

However, when the pressure control valve is press-fitted into the communication passage, a compressive stress as a result of the press-fitting is applied to a casing of the back pressure control valve and the clearance inside the back pressure control valve changes, and thus, the control accuracy of back pressure may become low. When the control accuracy of the back pressure becomes low, it is difficult to maintain the back pressure in the back pressure chamber at a predetermined value. As a result, the compression efficiency is reduced due to weak pressing of the orbiting scroll against the fixed scroll, and a drive force for driving the scroll unit is increased due to strong pressing.

Thus, an object of the present invention is to provide a scroll fluid machine which prevents the control accuracy of the back pressure from being reduced.

Means for Solving the Problem

A scroll fluid machine comprises a fixed scroll and an orbiting scroll engaged with each other, and a back pressure control valve inserted into a communication passage communicating between the back pressure chamber which applies a back pressure that presses the orbiting scroll against the fixed scroll and an outside of the back pressure chamber for controlling a pressure in the back pressure chamber. The scroll fluid machine further comprises a seal member fitted into a circumferential groove formed in an outer peripheral surface of the back pressure control valve, and a ring member press-fitted into the communication passage, in which the ring member fixes the back pressure control valve.

Effects of the Invention

According to the present invention, it is possible to prevent a reduction in the control accuracy of the back pressure.

MODE FOR CARRYING OUT THE INVENTION

An embodiment for implementing the present invention will be described in detail below with reference to attached drawings.

The scroll fluid machine can be used for a compressor or an expander. Here, the compressor is described as an example.

Figure 1:
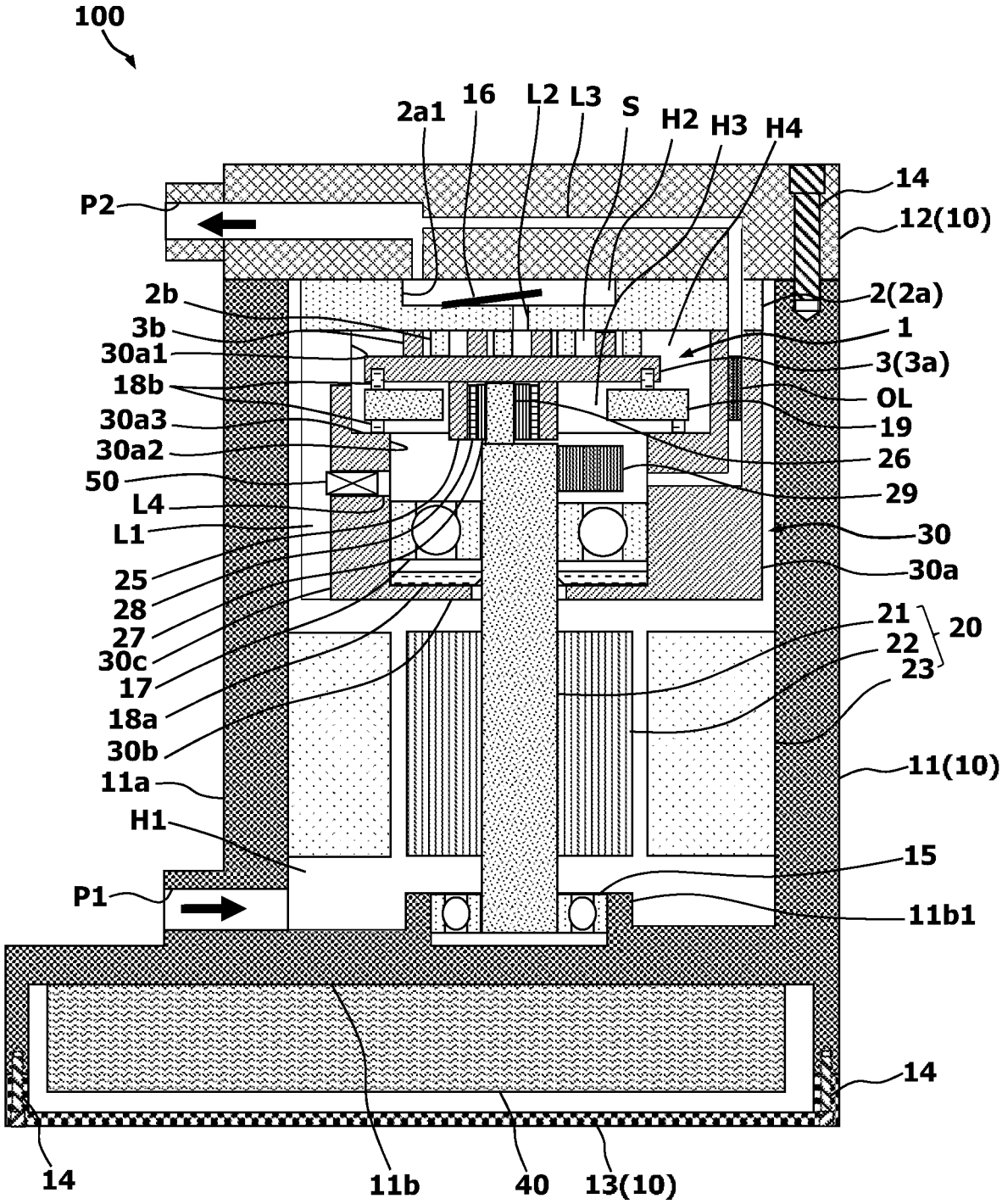
FIG. 1 is a schematic cross-sectional view illustrating an example of a scroll-type compressor.

FIG. 1 is an example of a scroll-type compressor.

The scroll-type compressor 100 is incorporated in a refrigerant circuit of an air conditioning apparatus for a vehicle, for example, and compresses a refrigerant (fluid) drawn from a low-pressure side of the refrigerant circuit to discharge the compressed refrigerant. The scroll-type compressor 100 includes a scroll unit 1, a housing 10 which internally includes a refrigerant suction chamber H1 and a refrigerant discharge chamber H2, an electric motor 20 serving as a drive unit which drives the scroll unit 1, a bearing retainer 30 for rotatably supporting one end (an upper end in FIG. 1) of a drive shaft 21 of the electric motor 20, and an inverter 40 for controlling driving of the electric motor 20. In the present embodiment, a $CO_2$ (carbon dioxide) refrigerant is employed as the refrigerant of the refrigerant circuit. Additionally, although a so-called inverterintegrated type compressor is given as an example for the scroll-type compressor 100, it can also be an inverter-separate type compressor.

The scroll unit 1 includes a fixed scroll 2 and an orbiting scroll 3 which are engaged with each other. The fixed scroll 2 is constituted by integrally forming a spiral wrap 2*b* on the disc-shaped base plate 2*a*. The orbiting scroll 3 is constituted by integrally forming a spiral wrap 3*b* on the disc-shaped base plate 3*a*. Additionally, the base plate 2*a* of the fixed scroll 2 has a diameter greater than the diameter of the base plate 3*a* of the orbiting scroll 3.

The fixed scroll 2 and orbiting scroll 3 are arranged such that the spiral wraps 2*b* and 3*b* engaged each other. Specifically, the fixed scroll 2 and orbiting scroll 3 are arranged so that a predetermined gap is provided between the protruding-side end of the spiral wrap 2*b* of the fixed scroll 2 and the base plate 3*a* of the orbiting scroll 3, and that a predetermined gap is provided between the protruding-side end of the spiral wrap 3*b* of the orbiting scroll 3 and the base plate 2*a* of the fixed scroll 2. During the compression operation, as will be described later, the orbiting scroll 3 is pressed against the fixed scroll 2 by the back pressure, and the air tightness of a compression chamber S can be appropriately maintained.

Additionally, the fixed scroll 2 and orbiting scroll 3 are arranged so that the side walls of the spiral wraps 2*b* and 3*b* are brought into partial contact with each other in a state in which the angles of the spiral wraps 2*b* and 3*b* in the circumferential direction are shifted from each other. Therefore, a crescent enclosed space, that is, the compression chamber S, is defined between the spiral wraps 2*b* and 3*b*.

The fixed scroll 2 is fixed to a rear housing 12 of the housing 10, and includes a recessed portion 2*a*1 which is formed in the radial center part of the rear housing 12 and which opens toward the rear housing 12. Specifically, the recessed portion 2*a*1 is formed in the back surface of the base plate 2*a*, that is, in the end surface opposite to the orbiting scroll 3.

The orbiting scroll 3 is arranged to be revolvable around the axis of the fixed scroll 2 via the drive shaft 21 in a state in which rotation of the orbiting scroll 3 is restricted. Therefore, the scroll unit 1 moves the compression chamber S defined between the fixed scroll 2 and orbiting scroll 3, that is, between the spiral wraps 2*b* and 3*b*, to the center portion to gradually reduce the volume of the compression chamber S. Accordingly, the scroll unit 1 compresses the refrigerant flowing from the outer end of the spiral wraps 2*b* and 3*b* into the compression chamber S.

The housing 10 includes a front housing 11 accommodating the scroll unit 1, the electric motor 20, the bearing retainer 30 and the inverter 40, the rear housing 12, and an inverter cover 13. Then, the front housing 11, the rear housing 12 and the inverter cover 13 are integrally fastened by fasteners such as bolts 14 to constitute the housing 10 of the electric compressor 100.

The front housing 11 includes a peripheral wall 11*a* having a substantially annular shape, and a partition wall section 11*b*. The inner space of the front housing 11 is partitioned by the partition wall section 11*b* into an accommodation space for accommodating the scroll unit 1, the electric motor 20 and the bearing retainer 30; and another accommodation space for accommodating the inverter 40. An opening on one end (the upper side in FIG. 1) of the peripheral wall 11*a* is closed by the rear housing 12. Additionally, an opening on the other end (the lower side in FIG. 1) of the peripheral wall 11*a* is closed by the inverter cover 13. In the radial center part of the partition wall section 11*b*, a cylindrical support section 11*b*1, which retains a bearing 15 for rotatably supporting the other end (lower end in FIG. 1) of the drive shaft 21 and which protrudes toward one end of the peripheral wall 11*a*.

Additionally, in the peripheral wall 11*a*, a refrigerant suction port P1 is formed. The refrigerant from the low-pressure side of the refrigerant circuit is drawn into the front housing 11 via the suction port P1. Accordingly, the space inside the front housing 11 functions as the suction chamber H1. In the present embodiment, the refrigerant flows through the periphery and the like of the electric motor 20 in the suction chamber H1 so as to cool the electric motor 20. The space above the electric motor 20 is in communication with the space below the electric motor 20, and constitutes one suction chamber H1 together with the space below the electric motor 20. Additionally, in the suction chamber H1, the refrigerant flows as the mixed fluid with a trace amount of lubricant oil.

The rear housing 12 has a disc-like shape with an outer diameter aligned with an outer diameter of the peripheral wall 11*a* of the front housing 11. Additionally, a peripheral edge of the rear housing 12 is fastened to one end of the peripheral wall 11*a* (upper end in FIG. 1) by using fasteners such as a plurality of bolts 14 to close an opening on one end of the front housing 11.

Additionally, a peripheral edge of the back surface of the base plate 2*a* of the fixed scroll 2, in other words, a portion surrounding the recessed portion 2*a*1, is brought into contact with one end surface of the rear housing 12. A refrigerant discharge chamber H2 is defined by the one end surface of the rear housing 12 and recessed portion 2*a*1 of the base plate 2*a*. In the center of the base plate 2*a*, a discharge passage L2 of a compressed refrigerant is formed. Additionally, in the discharge chamber H2, a one-way valve 16 such as a check valve which regulates a flow from the discharge chamber H2 toward the scroll unit 1 is arranged to cover an opening of the discharge passage L2. The refrigerant compressed in the compression chamber S is discharged to the inside of the discharge chamber H2 via the discharge passage L2 and the one-way valve 16. Additionally, a discharge port P2 which communicates between the discharge chamber H2 and the outside, that is, the high-pressure side of the refrigeration circuit, is formed in the rear housing 12. The compressed refrigerant in the discharge chamber H2 is discharged to the high-pressure side of the refrigerant circuit via the discharge port P2.

Although not illustrated in the drawings, an oil separator for separating the lubricant oil from the compressed refrigerant that flowed into the discharge port P2 is arranged. The refrigerant, from which the lubricant oil has been separated by the oil separator (including the refrigerant in which a trace amount of lubricant oil remains), is discharged to the high-pressure side of the refrigeration circuit via the discharge port P2. On the other hand, the lubricating oil separated by the oil separator is introduced into a pressure supply passage L3, which is described later.

For example, the electric motor 20 is constituted by a three-phase AC motor, and has the drive shaft 21, a rotor 22, and a stator core unit 23 arranged radially outward of the rotor 22. Then, the direct current from a battery (not illustrated) of the vehicle is converted to an alternating current by the inverter 40, and the alternating current is fed to the stator core unit 23 of the electric motor 20.

The drive shaft 21 is connected to the orbiting scroll 3 via a crank mechanism, and transmits the rotational force of the electric motor 20 to the orbiting scroll 3. One end of the drive shaft 21, that is, the orbiting scroll 3-side end, penetrates through a through hole formed in the bearing retainer 30 so as to be rotatably supported by a bearing 17. The other end of the drive shaft 21, that is, the inverter 40-side end, is rotatably supported by the bearing 15 fitted into the support section 11*b*1.

The rotor 22 is rotatably supported radially inward of the stator core unit 23 via the drive shaft 21, which is fitted (e.g., press-fitted) into a shaft hole formed at the radial center of the rotor 22. When a magnetic field is generated in the stator core unit 23 by the power supply from the inverter 40, a rotational force is applied to the rotor 22 to rotationally drive the drive shaft 21.

The bearing retainer 30 is arranged in the front housing 11, and retains the bearing 17 as a bearing portion which rotatably supports the orbiting scroll 3-side end of the drive shaft 21. The bearing retainer 30 is formed, for example, in a shape of a bottomed cylinder having an outer diameter that is aligned with the outer diameter of the base plate 2*a* of the fixed scroll 2, and includes a cylindrical portion 30*a* and a bottom wall 30*b* located on the side of one end of the cylindrical portion 30*a*. The inner diameter on the opening side of the cylindrical portion 30*a* is enlarged to be greater than the inner diameter on the side of the bottom wall 30*b*, and the cylindrical portion 30*a* includes a shoulder portion 30*a*3 which connects a large diameter portion 30*a*1 to a small diameter portion 30*a*2 of the cylindrical portion 30*a*. The orbiting scroll 3 is accommodated in a space defined by the large diameter portion 30*a*1 and the shoulder portion 30*a*3. An opening end of the cylindrical portion 30*a* is brought into contact with a peripheral edge of an end surface of the base plate 2*a* on the side of the orbiting scroll 3. Accordingly, the opening of the bearing retainer 30 is closed by the fixed scroll 2. Additionally, the bearing 17 is fitted into the small diameter portion 30*a*2 of the cylindrical portion 30*a*. Moreover, in the radial center part of the bottom wall 30*b*, a through hole for penetrating the orbiting scroll 3-side end of the drive shaft 21 is formed. A seal member 18*a* is arranged between the bearing 17 and the bottom wall 30*b*, and thus, air-tightness of the back pressure chamber H3, which will be described later, is maintained.

A circular thrust plate 19 is arranged between the shoulder portion 30*a*3 of the bearing retainer 30 and base plate 3*a* of the orbiting scroll 3. The shoulder portion 30*a*3 receives the thrust force from the orbiting scroll 3 via the thrust plate 19. Each seal member 18*b* is arranged in the portion which is brought into contact with the thrust plate 19 of the shoulder portion 30*a*3 and the base plate 3*a*.

Additionally, the back pressure chamber H3 is defined between the base plate 3*a* and the small diameter portion 30*a*2 by the seal members 18*a*, 18*b*. That is, the back pressure chamber H3 is formed between the bearing retainer 30 and the orbiting scroll 3. Additionally, between the inner peripheral surface of the peripheral wall 11*a* of the front housing 11 and the outer peripheral surface of the cylindrical portion 30*a* of the bearing retainer 30, there is formed a fluid introduction passage L1, which communicates between the suction chamber H1 and a space H4 near the outer peripheries of the spiral wraps 2*b* and 3*b* of the scroll unit 1, and introduces the refrigerant, specifically, a mixed fluid including the refrigerant and a trace amount of lubricant oil, from the suction chamber H1 into the space H4. More specifically, the fluid introduction passage L1, which communicates between the suction chamber H1 and the space H4, is formed by cooperation between the inner peripheral surface of the peripheral wall 11*a* of the front housing 11 and the outer peripheral surface of the cylindrical portion 30*a* of the bearing retainer 30. Accordingly, the pressure inside the space H4 is equal to the pressure inside the suction chamber H1.

The crank mechanism includes: a cylindrical boss 25, which is formed to protrude from the back surface of the base plate 3*a* of the orbiting scroll 3 (the back pressure chamber H3-side end surface); an eccentric bush 27, which is attached in an eccentric state to a crank 26 formed on the orbiting scroll 3-side end of the drive shaft 21, and a slide bearing 28, which is fitted into the boss 25. The eccentric bush 27 is rotatably supported inside the boss 25 via the slide bearing 28. A balancer weight 29, which opposes the centrifugal force generated when the orbiting scroll 3 is operated, is attached to the orbiting scroll 3-side end of the drive shaft 21. Additionally, although not illustrated, the rotation blocking mechanism which restricts rotation of the orbiting scroll 3 is provided. This allows the orbiting scroll 3 to be revolvable around the axis of the fixed scroll 2 via the crank mechanism in a state in which the rotation of the orbiting scroll 3 is restricted.

Figure 2:
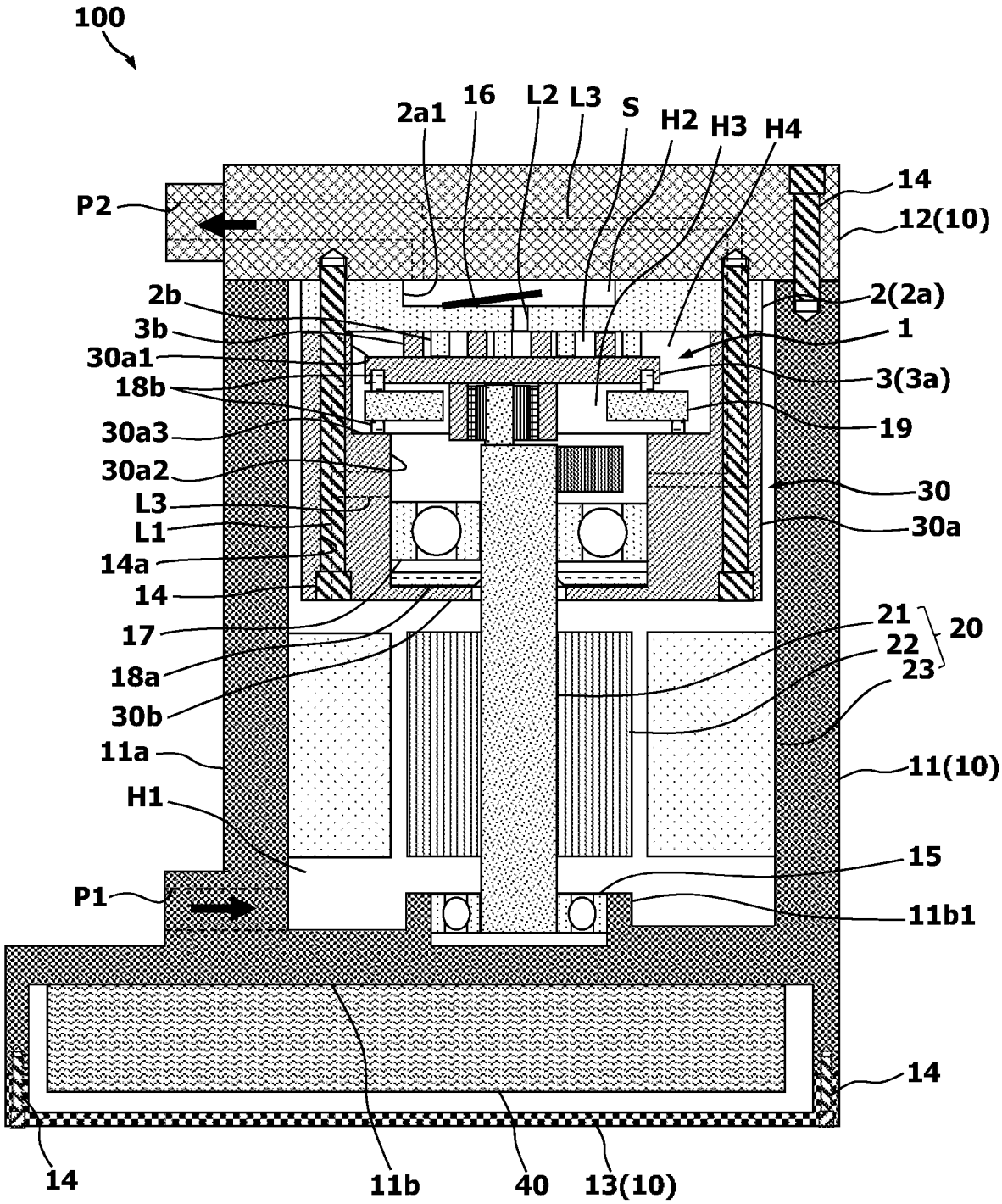
FIG. 2 is a schematic cross-sectional view for describing a fastening state of a bearing retainer of the scroll-type compressor.

FIG. 2 illustrates a cross section through the center axes of the bolts 14 for fastening the bearing retainer 30, in order to describe the fastening state of the bearing retainer 30.

The bearing retainer 30 is fastened by the fastening bolts 14 integrally with the fixed scroll 2 and the rear housing 12 in a state in which the fixed scroll 2 is arranged between the bearing retainer 30 and the rear housing 12.

Specifically, the fixed scroll 2 is held between the rear housing 12 and the bearing retainer 30 in a state in which a peripheral edge of the back surface of the base plate 2*a* is brought into contact with one end surface of the rear housing 12, and also a peripheral edge of the other end surface of the base plate 2*a* on the side of the orbiting scroll 3 is brought into contact with an opening end of the cylindrical portion 30*a* of the bearing retainer 30. The bearing retainer 30 and the fixed scroll 2 include through holes 14*a*, which are respectively opened on the peripheral edges of the bearing retainer 30 and the fixed scroll 2, that is, the peripheral edges of the cylindrical portion 30*a* and the base plate 2*a*, at a plurality of locations spaced in the circumferential direction of the bearing retainer 30 to extend in the extending direction of the drive shaft 21, and through the through holes 14*a*, the fastening bolts 14 for fastening with the fixed scroll 2 and the rear housing 12 are penetrated. Additionally, female screw portions are formed on one end surface of the rear housing 12 at locations which correspond to the locations of openings of the through holes 14. The bolts 14 are inserted into the through holes 14*a* of the cylindrical portion 30*a* and the base plate 2*a* to be threadably fitted into the female screw portions of the rear housing 12. In the above-described manner, the bearing retainer 30 is fastened integrally with the fixed scroll 2 and the rear housing 12.

The fluid introduction passage L1 extends along a recessed portion 30*c* (see FIG. 1) which extends in the extending direction of the drive shaft 21 in a portion between the portions of the peripheral edge of the bearing retainer 30, that is, the cylindrical portion 30*a*, in which the through holes 14*a* are formed. Specifically, the fluid introduction passage L1 is defined mainly by a portion recessed toward the drive shaft 21 for weight reduction in a portion of the cylindrical portion 30*a* other than the portions in which the through holes 14*a* are formed (i.e., the recessed portion 30*c*) and a corresponding portion of the inner peripheral surface of the peripheral wall 11*a* that faces the above-described portion of the cylindrical portion 30*a*. Additionally, one end of the fluid introduction passage L1 opens to the suction chamber H1, and the other end of the fluid introduction passage L1 penetrates through an end of the cylindrical portion 30*a* to open to the space H4.

Figure 3:
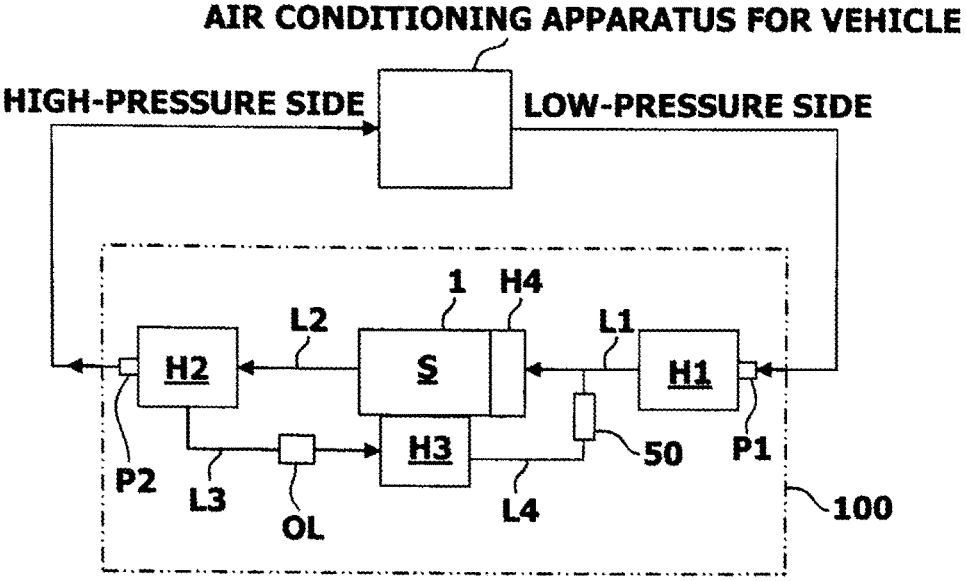
FIG. 3 is a block diagram for describing a fluid flow in the scroll-type compressor.

FIG. 3 is a block diagram which describes a flow of the refrigerant in the scroll-type compressor 100.

The refrigerant from the low-pressure side of the refrigerant circuit is introduced into the suction chamber H1 via the suction port P1, and is then guided into the space H4 formed around the outer end of the scroll unit 1 via the fluid introduction passage L1. Then, the refrigerant in the space H4 is taken into the compression chamber S between the spiral wraps 2*b* and 3*b* to be compressed in the compression chamber S. The refrigerant compressed in the compression chamber S is discharged into the discharge chamber H2 via the discharge passage L2 and the one-way valve 16, and is then discharged from the discharge chamber H2 to the high-pressure side of the refrigerant circuit via the discharge port P2. In this way, the scroll unit 1 compresses the refrigerant that flowed into the suction chamber H1 inside the compression chamber S and discharges the compressed refrigerant via the discharge chamber H2.

Referring back to FIG. 1, the scroll-type compressor 100 further includes a back pressure control valve 50 for adjusting the back pressure inside the back pressure chamber H3.

The back pressure control valve 50 is a unit-type differential-pressure-operation-type check valve which integrates at least a valve body, an elastic body such as a spring for biasing the valve body in the valve closing direction, and a casing for accommodating the valve body and elastic body. The back pressure control valve 50 operates in a valve opening direction when the differential pressure between the pressure inside the back pressure chamber H3 and the pressure inside the suction chamber H1 is greater than a predetermined differential pressure, and operates in a valve closing direction when the abovementioned differential pressure is equal to or lower than the predetermined differential pressure, so as to adjust the pressure inside the back pressure chamber H3 to be a predetermined pressure (intermediate pressure) which is between the pressure inside the discharge chamber H2 (high pressure) and the pressure inside the suction chamber H1 (low pressure).

As illustrated in FIGS. 1 to 3, the scroll-type compressor 100 further includes the pressure supply passage L3 and a pressure release passage L4 in addition to the fluid introduction passage L1 and the discharge passage L2. The pressure release passage L4 is given as an example of the communication passage for communicating the back pressure chamber and an outside of the back pressure chamber.

The pressure supply passage L3 is a passage for communication between the discharge chamber H2 and the back pressure chamber H3. The lubricant oil, after being separated by the oil separator (not illustrated) from the compressed refrigerant, is guided into the back pressure chamber H3 via the pressure supply passage L3, and is used for lubrication of each slide site inside the back pressure chamber H3. The communication between the discharge chamber H2 and the back pressure chamber H3 via the pressure supply passage L3 increases the pressure inside the back pressure chamber H3.

The pressure supply passage L3 specifically includes a passage which is formed in the rear housing 12 such that one end of the passage opens to the discharge chamber H2 via the discharge port P2 and the other end opens to the portion of contact with the base plate 2*a*, a passage which is connected to the above-described passage and penetrates through the base plate 2*a*, and a passage which is connected to the above-described passage and penetrates through the cylindrical portion 30*a* to open to the back pressure chamber H3. An orifice OL is arranged in the middle of the pressure supply passage L3. Accordingly, the lubricant oil separated from the compressed refrigerant in the discharge chamber H2 is, while being decompressed by the orifice OL, supplied into the back pressure chamber H3 via the pressure supply passage L3.

The pressure release passage L4 is a communication passage which communicates between the back pressure chamber H3 and the suction chamber H1.

Specifically, the pressure release passage L4 penetrates through the small diameter portion 30*a*2 of the cylindrical portion 30*a* of the bearing retainer 30, and extends in a direction perpendicular to the drive shaft 21. Additionally, one end of the pressure release passage L4 opens to the back pressure chamber H3, and the other end of the pressure release passage L4 opens to the fluid introduction passage L1. Here, the other end of the pressure release passage L4 opens to the suction chamber H1, in short, the outside of the back pressure chamber H3, via the fluid introduction passage L1.

Next, the back pressure control operation performed by the back pressure control valve 50 is described.

The back pressure control valve 50 uses the elastic body to bias the valve body in a valve closing direction to close the pressure release passage L4 that communicates between the back pressure chamber H3 and the suction chamber H1. Here, the biasing force in the valve closing direction by the elastic body, the biasing force in the valve closing direction by the pressure in the suction chamber H1, and the biasing force in the valve opening direction by the pressure in the back pressure chamber H3 are applied to the valve body.

Then, when the pressure in the back pressure chamber H3 increases, the biasing force in the valve opening direction by the pressure in the back pressure chamber H3 increases, and when it becomes greater than the resultant force of the biasing force in the valve closing direction by the elastic body and the biasing force in the valve closing direction by the pressure in the suction chamber H1, the valve body moves in the valve opening direction to open the pressure release passage L4. Then, the lubricant oil in the back pressure chamber H3 is released to the suction chamber H1 via the pressure release passage L4, and the pressure in the back pressure chamber H3 is reduced. When the pressure in the back pressure chamber H3 is reduced, the biasing force in the valve opening direction resulting from the pressure in the back pressure chamber H3 decreases, and when the biasing force in the valve opening direction becomes smaller than the resultant force of the biasing force in the valve closing direction by the elastic body and the biasing force in the valve closing direction by the pressure in the suction chamber H1, the valve body moves in the valve closing direction to close the pressure release passage L4. Thus, by appropriately selecting the spring constant of the elastic body, the pressure in the back pressure chamber H3 can be controlled to be a predetermined pressure.

When the back pressure control valve 50 is press-fitted into the pressure release passage L4, the compressive stress caused by the press-fitting is applied to the casing of the back pressure control valve 50 to change the clearance (passage) inside the back pressure control valve 50. In the scroll-type compressor 100 using the $CO_2$ refrigerant, the compression factor of the refrigerant by the scroll unit 1 is high, and thus, even a small change in the clearance inside the back pressure control valve 50 reduces its back pressure control accuracy. Thus, the structure for attaching the back pressure control valve 50 to the pressure release passage L4 is revised so that the compressive stress which is applied to the back pressure control valve 50 is reduced, and that the reduction in the back pressure control accuracy is prevented.

Figure 4:
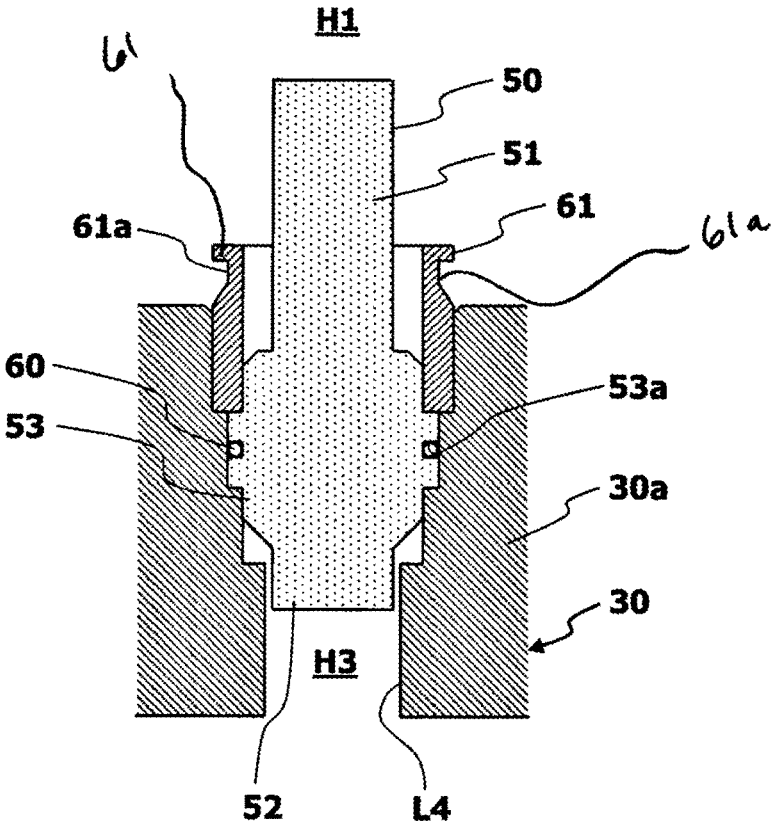
FIG. 4 is a schematic cross-sectional view for describing an example of a back pressure control valve and an attachment structure of the back pressure control valve.

FIG. 4 illustrates the back pressure control valve 50 and the attachment structure of the back pressure control valve 50.

The back pressure control valve 50 has the first small diameter part 51 facing the suction chamber H1, the second small diameter part 52 facing the back pressure chamber H3, and the large diameter part 53, which connects the first small diameter part 51 and a second small diameter part 52. The intermediate part of the large diameter part 53 is formed to protrude in an annular shape radially outwardly, and the rectangular-cross-section-shaped circumferential groove 53*a* for fitting the O-ring 60 is formed in the outer peripheral surface of the large diameter part 53. A through hole which penetrates the first small diameter part 51, the second small diameter part 52 and the large diameter part 53 is formed inside the back pressure control valve 50, and here, a valve seat on which a valve body sits, and the elastic body for biasing the valve body in the valve closing direction are arranged. The O-ring 60 is given as an example of the seal member.

The pressure release passage L4 of the bearing retainer 30 is formed in a stepped shape which is gradually reduced in diameter from the suction chamber H1 toward the back pressure chamber H3. Specifically, a portion of the pressure release passage L4, which opens to the suction chamber H1, is formed to have a slightly smaller inner diameter than the outer diameter of the ring member 61 such that the ring member 61 (which is described later in detail) for fixing the back pressure control valve 50 is press-fitted. The subsequent portion has the same length as the protruding portion of the large diameter part 53 of the back pressure control valve 50, and is formed having a slightly larger inner diameter than the outer diameter of the protruding portion of the large diameter part 53. The subsequent portion is formed having a slightly larger inner diameter than the outer diameter of the large diameter part 53 of the back pressure control valve 50. The further subsequent portion, that is, the portion which is open to the back pressure chamber H3, is formed to have a slightly larger inner diameter than the outer diameter of the second small diameter part 52 of the back pressure control valve 50. Accordingly, the back pressure control valve 50 has a minute gap between it and the pressure release passage L4 of the bearing retainer 30, and is easily detachable with respect to the pressure release passage L4.

The ring member 61, which is constituted by a metal cylinder, for example, has an inner diameter which is the same as the outer diameter of the large diameter part 53 of the back pressure control valve 50, and has an outer diameter which can be press-fitted into the portion of the pressure release passage L4, which is open to the suction chamber H1. Additionally, in the outer periphery of the ring member 61, at a vicinity of the end of the portion protruding from the pressure release passage L4 to the suction chamber H1, there is formed a circumferential groove 61*a*, having an annular flat surface that is parallel to one end of the ring member 61. Accordingly, the ring member 61, which is press-fitted into the pressure release passage L4 of the bearing retainer 30, can be easily removed, if, for example, a tool having three nail parts arranged at equal angles is used to lock tips of the nail parts with the circumferential groove 61*a* to pull out the ring member 61. In short, the ring member 61 has a portion protruding from the pressure release passage L4, and the outer peripheral surface of the ring member 61 forms the circumferential groove 61*a* with which the tool can be locked. Here, the circumferential groove 61*a* is given as an example of the locking part.

In the state in which the back pressure control valve 50 is inserted from the large-diameter side of the pressure release passage L4, the lower surface of the protruding portion of the large diameter part 53 of the back pressure control valve 50 is locked with the shoulder portion (stepped portion) of the stepped shape, and the attaching position of the back pressure control valve 50 with respect to the pressure release passage L4 can be specified. Here, since the protruding portion of the large diameter part 53 has the same length as that of a part of the stepped shape of the pressure release passage L4, the upper surface of the protruding portion becomes the same surface as the shoulder portion of the portion of the pressure release passage L4 which is open to the suction chamber H1, and the space for press-fitting the ring member 61 is secured. Additionally, since the O-ring 60 is fitted into the circumferential groove 53*a* of the large diameter part 53, even if the minute gap between the back pressure control valve 50 and the pressure release passage L4 exists, the air tightness between them can be secured.

Then, the ring member 61 is press-fitted into the portion of the pressure release passage L4 which is open to the suction chamber H1, that is, the large-diameter side of the pressure release passage L4. The tip portion of the ring member 61, that is, the end at the side of the back pressure chamber H3, is in contact with the back pressure control valve 50 and the shoulder portion of the pressure release passage L4, and the protruding portion of the large diameter part 53 of the back pressure control valve 50 is held between the tip portion of the ring member 61 and the shoulder portion so that the back pressure control valve 50 is fixed in a predetermined position.

By doing so, the back pressure control valve 50, while securing the air tightness with respect to the pressure release passage L4, can avoid the compressive stress due to press fitting to be applied to the casing. Thus, the clearance inside the back pressure control valve 50 becomes difficult to change, and the reduction in the control accuracy of back pressure can be prevented. Then, the reduction in the compression efficiency due to weakness in pressing of the orbiting scroll 3 against the fixed scroll 2, and the increase in the drive force for driving the scroll unit 1 due to strong pressing can be prevented.

The embodiment for implementing the present invention has been described; however, the present invention is not limited to this embodiment, and it can be variously modified and altered based on the technical idea, as an example is provided below.

Figure 5:
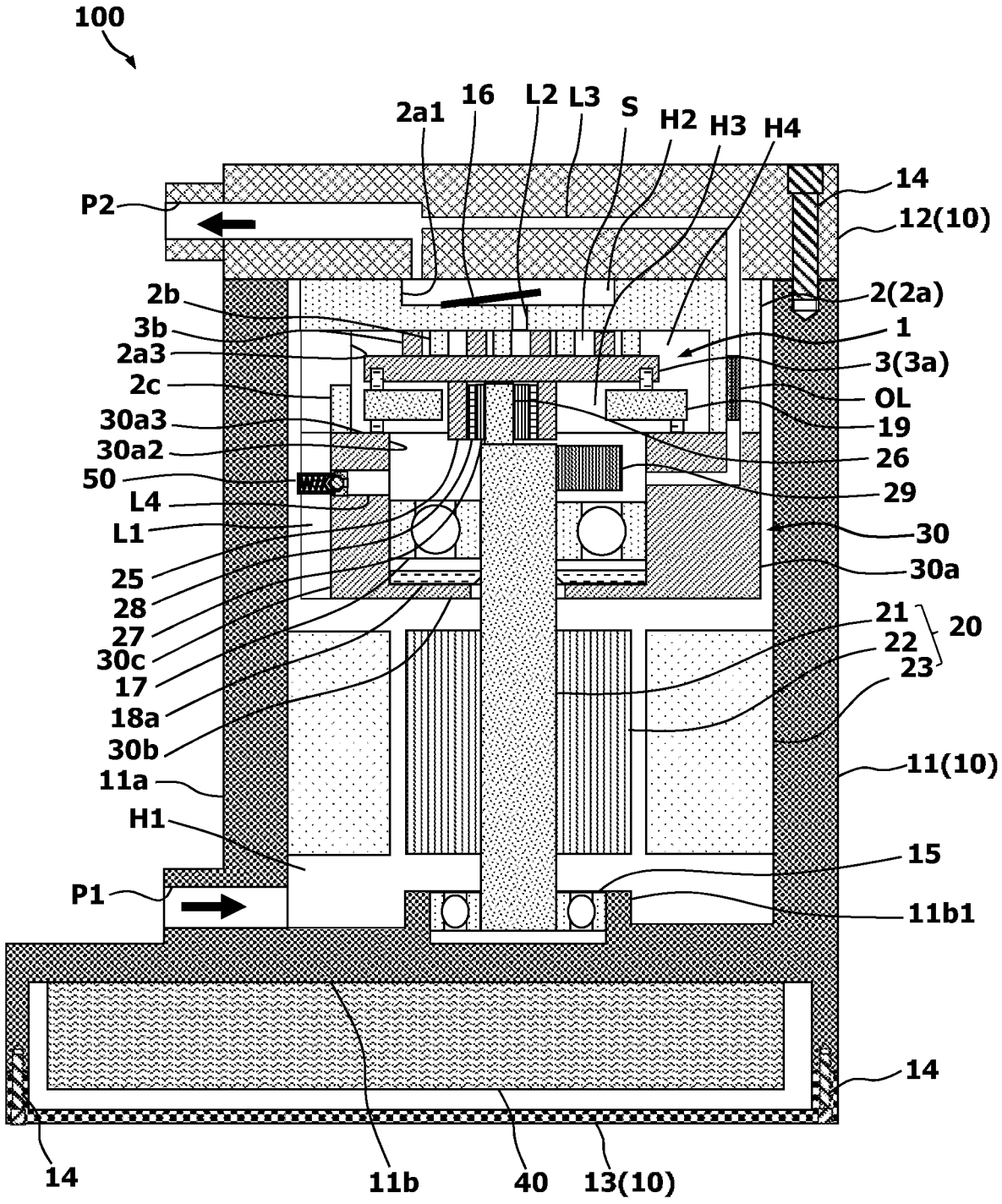
FIG. 5 is a schematic cross-sectional view for describing a modification of a bearing retainer and a fixed scroll of the scroll-type compressor.

The orbiting scroll 3 can be accommodated in the fixed scroll 2 as illustrated in FIG. 5, instead of being accommodated in the bearing retainer 30. In this case, a large diameter portion 2*a*3, in which the peripheral edge of the base plate 2*a* of the fixed scroll 2 is protruded toward the bearing retainer 30, is formed, and the orbiting scroll 3 is accommodated in the large diameter portion 2*a*3. Additionally, the bearing retainer 30 may include the small diameter portion 30*a*2 for fitting the bearing 17 into the cylindrical portion 30*a*. Additionally, in this modification, the fluid introduction passage L1 is formed by cooperation among the inner surface of the peripheral wall 11*a* of the front housing 11, the outer peripheral surface of the bearing retainer 30 (the inner surface of the recessed portion 30*c*), and the outer peripheral surface of the fixed scroll 2 (the inner surface of a recessed portion 2*c* extended in communication with the recessed portion 30*c*).

If there is no need to, or little probability of, removing the ring member 61 from the pressure release passage L4, the circumferential groove 61*a* does not have to be formed in the outer peripheral surface of the ring member 61. Additionally, the back pressure control valve 50 is not limited to the bearing retainer 30, and it can be arranged on the pressure release passage L4 formed in the fixed scroll 2 or the rear housing 12, for example. Furthermore, if the large-diameter side of the pressure release passage L4 is located on the side of the back pressure chamber H3, the back pressure control valve 50 having an inverse internal structure can be inserted from the side of the back pressure chamber H3 to press-fit the ring member 61 from the large-diameter side of the pressure release passage L4.

The locking part which uses the tool to remove the ring member 61 from the pressure release passage L4 is not limited to the circumferential groove 61*a* formed in the outer peripheral surface of the protruding portion of the ring member 61, but can be the circumferential groove formed in the inner peripheral surface thereof, the outer peripheral surface, or a plurality of projections or recessed portions formed in or the outer peripheral surface thereof. In this case, the plurality of projections or recessed portions is preferably formed at equal intervals (equal angles) in order for the nail parts of the tool to allow locking and pulling out.

Additionally, the pressure release passage L4 need not necessarily be the stepped shape, if, for example, the attaching position of the back pressure control valve 50 can be specified by projections and the like which protrude from the inner peripheral surface. In this case, the back pressure control valve 50 and the ring member 61 can be inserted and press-fitted from an opening of one end of the pressure release passage L4.

REFERENCE SYMBOL LIST

2 Fixed scroll
3 Orbiting scroll
50 Back pressure control valve
53*a* Circumferential groove
60 O-ring (seal member)
61 Ring member
61*a* Circumferential groove
L4 Pressure release passage (communication passage)
H1 Suction chamber (outside of the back pressure chamber)
H3 Back pressure chamber

The invention claimed is:

1. A scroll fluid machine comprising:

a fixed scroll and an orbiting scroll engaged with each other;

a back pressure control valve inserted into a communication passage communicating between a back pressure chamber which applies a back pressure that presses the orbiting scroll against the fixed scroll and an outside of the back pressure chamber for controlling a pressure in the back pressure chamber;

a seal member fitted into a circumferential groove formed in an outer peripheral surface of the back pressure control valve;

a ring member press-fitted into the communication passage to fix the back pressure control valve;

wherein the ring member is constituted by a member that is different from the back pressure control valve, and has a portion protruding from the communication passage;

the protruding portion forms a locking part with which a tool can be locked, the communication passage is a stepped shape;

the back pressure control valve is inserted from a large-diameter side of the communication passage; and the ring member is press-fitted into the large-diameter side of the communication passage, and holds and fixes the back pressure control valve between the ring member and a stepped portion of the communication passage.

2. The scroll fluid machine according to claim 1, wherein the fixed and orbiting scrolls compress or expand a $CO_2$ refrigerant.

3. The scroll fluid machine according to claim 2, wherein the back pressure control valve is a unit-type differential-pressure-operation-type check valve which integrates at least a valve body, an elastic body for biasing the valve body in the valve closing direction, and a casing for accommodating the valve body and elastic body.

4. The scroll fluid machine according to claim 1, wherein the locking part is a circumferential groove formed in an outer peripheral surface or an inner peripheral surface of the protruding portion.

5. The scroll fluid machine according to claim 4, wherein the back pressure control valve is a unit-type differential-pressure-operation-type check valve which integrates at least a valve body, an elastic body for biasing the valve body in the valve closing direction, and a casing for accommodating the valve body and elastic body.

6. The scroll fluid machine according to claim 1, wherein the locking part is a plurality of projections formed on an outer peripheral surface or an inner peripheral surface of the protruding portion.

7. The scroll fluid machine according to claim 6, wherein the back pressure control valve is a unit-type differential-pressure-operation-type check valve which integrates at least a valve body, an elastic body for biasing the valve body in the valve closing direction, and a casing for accommodating the valve body and elastic body.

8. The scroll fluid machine according to claim 1, wherein the locking part is a plurality of recessed portions formed in an outer peripheral surface or an inner peripheral surface of the protruding portion.

9. The scroll fluid machine according to claim 8, wherein the back pressure control valve is a unit-type differential-pressure-operation-type check valve which integrates at least a valve body, an elastic body for biasing the valve body in the valve closing direction, and a casing for accommodating the valve body and elastic body.

10. The scroll fluid machine according to claim 1, wherein the back pressure control valve is a unit-type differential-pressure-operation-type check valve which integrates at least a valve body, an elastic body for biasing the valve body in the valve closing direction, and a casing for accommodating the valve body and elastic body.

11. The scroll fluid machine according to claim 10, wherein the outside of the back pressure chamber is a fluid suction chamber.

12. The scroll fluid machine according to claim 1, wherein the outside of the back pressure chamber is a fluid suction chamber.

* * * * *